United States Patent [19]

von Schneidemesser et al.

[11] 4,370,835

[45] Feb. 1, 1983

[54] WORKING PRESSURE CONTROL MECHANISM

[75] Inventors: Christian von Schneidemesser; Paul G. Nowotka; Gerhard Rüdel, all of Rendsburg, Fed. Rep. of Germany

[73] Assignee: Peter Wolters, Rendsburg, Fed. Rep. of Germany

[21] Appl. No.: 217,827

[22] Filed: Dec. 18, 1980

[30] Foreign Application Priority Data

Dec. 18, 1979 [DE] Fed. Rep. of Germany ..... 2950881

[51] Int. Cl.[3] ..... B24B 49/10

[52] U.S. Cl. ..... 51/165.77; 51/109 R; 51/111 R; 51/165.92

[58] Field of Search ..... 51/109, 110, 117, 118, 51/165.77, 165.92, 111

[56] References Cited

U.S. PATENT DOCUMENTS

| | | | |
|---|---|---|---|
| 2,085,005 | 6/1937 | Cole | 51/118 |
| 2,227,697 | 1/1941 | Blood | 51/109 |
| 2,618,911 | 11/1952 | Indge | 51/118 |
| 3,035,377 | 5/1962 | Bovensiepen | 51/109 |
| 3,100,954 | 8/1963 | Lella | 51/165.77 |
| 3,897,660 | 8/1975 | Chijiiwa | 51/165.77 |
| 3,939,610 | 2/1976 | Suzuki | 51/165.77 |

FOREIGN PATENT DOCUMENTS 2204581 12/1977 Fed. Rep. of Germany .

*Primary Examiner*—Harold D. Whitehead
*Attorney, Agent, or Firm*—Holman & Stern

[57] ABSTRACT

A working pressure control mechanism for lapping, honing, and grinding machines having a rotatably mounted shaft bearing the tool within an axially translatable housing such that the shaft is carried along by the housing in the direction of the tool advance, comprising a spring capable of axially translating the housing, a signal producer capable of producing a signal corresponding to the magnitude of axial displacement caused by the workpiece and connected to the spring, and a mechanism advance control capable of receiving a signal from the signal producer, and advancing the housing to compensate for the degree of axial displacement.

1 Claim, 4 Drawing Figures

WORKING PRESSURE CONTROL MECHANISM

BACKGROUND OF THE INVENTION

1. Field of the Invention

The invention concerns a working pressure control mechanism for lapping, honing, and grinding machines.

2. Description of the Prior Art

In machining with these types of machines, the pressure exerted by the tool (the lapping, honing, or grinding wheel) on the surface of the workpiece is of critical importance. With excessive pressure, there is the danger of adverse effects on the desired quality of the surface, possibly cold welding of workpiece and tool, and in the case of lapping machines, the pulling away of the lapping film containing the lapping compound. With insufficient pressure, machining times become unnecessarily long and machining costs increase.

In the past, as a rule, the pressure on the workpiece in such machines has been adjusted by hand, by hydraulic or pneumatic thrust, by adjusting the pressure, i.e., force of the machining wheel in the axial direction against the medium which moves the workpiece. German published application No. 22 04 581 discloses a working pressure control mechanism for a lapping or honing machine, with which the spinnable machine shaft bearing the tool is rotatably mounted in an axially translatable piece such that said shaft is carried along by said piece in the direction of the advance, with the working pressure being adjusted according to a calculated or empirically determined curve, wherewith, e.g., a suitable jig is used as the programming control organ. Such controls can only follow fixed values, which often differ substantially from actual conditions in practice.

SUMMARY OF THE INVENTION

The underlying problem of this invention is to devise a mechanism of the general type described above, whereby the applied force of the tool on the workpiece is continuously kept at an optimum value.

This problem is solved according to the invention by carrying the spinning shaft along with (and by the agency of) the abovementioned translatable piece, said carrying along being by spring-loaded means connected to a sensing device which produces a signal corresponding to the magnitude of the relative motion of the spinning shaft and the translatable piece. This signal is then transmitted to a device for controlling the advance mechanism in accordance with this relative motion. Preferably the shaft is rotatably mounted in a bushing parallel to its axis, and is mounted so that it is not axially movable with respect to the bushing, and this arrangement is configured such that the bushing is axially movable relative to the translatable (advanceable) piece, against springs, the bushing being connected to a device for measuring this relative motion.

With this structural design, the bushing can be rotatably mounted on a flange of the rotating part via ball bearings, and can be braced against the axially translatable piece in both directions by springs. Preferably the bushing is connected to a measuring device which has in its output circuit a device for comparing the measured quantity, which device controls the advancing force of the translatable piece.

According to another preferred embodiment of the invention, the bushing has at least one region along its length which is elastically deformable by the force applied to it due to the advancement of the tool and bears a sensing strip whose electrical resistance varies with changes in its length. This strip is connected to the input of a comparator which controls the advancing force of the translatable (advanceable) piece. The use of strain gauge strips for measuring the advance in a grinding machine is basically known (see German published application No. 19 29 518).

BRIEF DESCRIPTION OF THE DRAWINGS

The drawings show examples of embodiments of a rotatable mounting according to the invention, with reference to a two-disc lapping machine.

DESCRIPTION OF THE PREFERRED EMBODIMENTS

Figure 1:
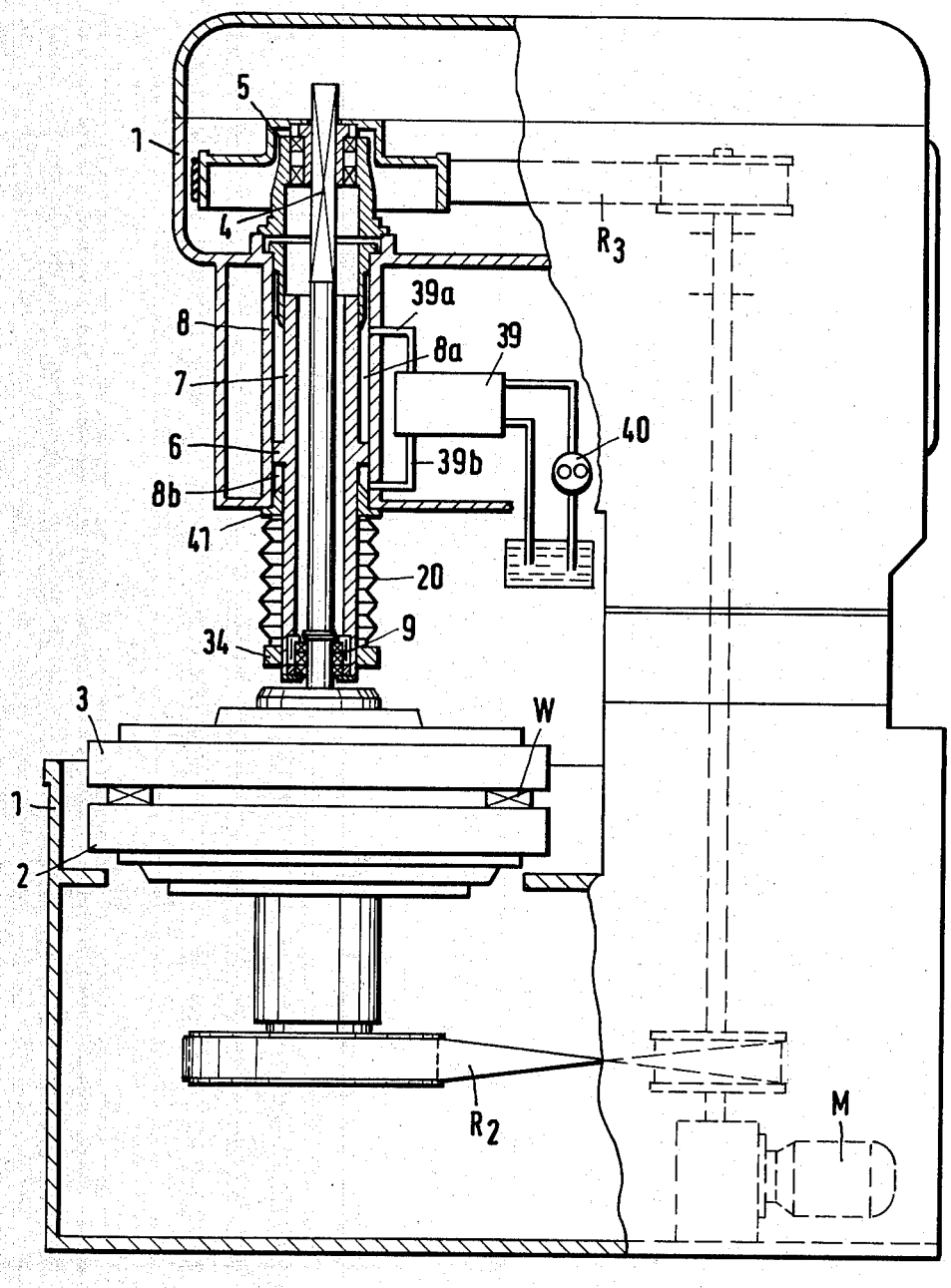
FIG. 1 is partly a side view and partly a vertical cross-section of a bearing according to this invention installed on the upper lapping disc shaft of a lapping machine.

In the two-disc lapping machine represented in FIG. 1, the lower lapping disc 2 is positionally fixedly supported in the machine frame 1 and is driven by a motor M via a first belt drive R2. The upper lapping disc 3 is at the lower end of a vertical shaft 4 which is driven by the same motor M via a second belt drive R3, in the opposite direction to lower lapping disc 2. The upper end of shaft 4 is rotatably mounted in an upper bearing assemblage 5 attached to the machine frame, whereby said shaft can spin on its axis and can be moved axially. Also, a short distance above upper lapping disc 3, shaft 4 is rotatably mounted in a lower bearing assemblage 9 interior to the hollow piston rod 7 of a piston (housing) 6 which is vertically movable in a cylinder 8.

Figure 2:
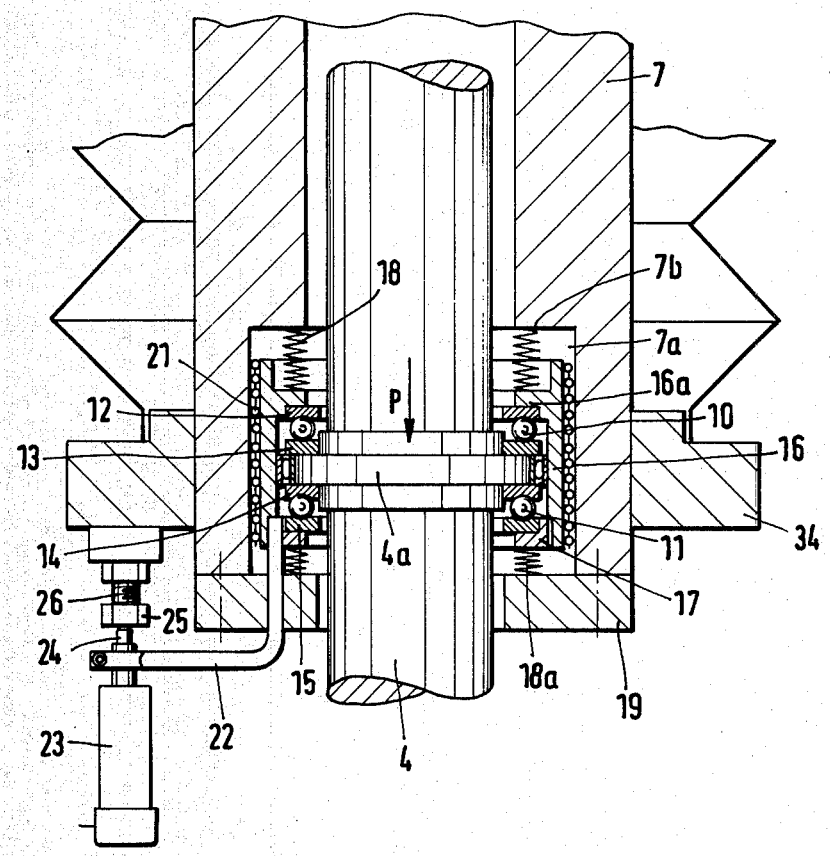
FIG. 2 is an enlarged view of the bearing.

In the version of lower bearing assemblage 9 represented in FIG. 2, there are two successive ball bearing assemblies, each assembly having two ball bearing races defined by rings enclosing the ball bearings which shall be referred to as an "upper assembly" and a "lower assembly", the lower assembly being closest to the lapping discs. The upper assembly comprises upper first ring 12 and upper second ring 13 defining a ball bearing race in which are located upper ball bearings 10. The lower assembly comprises lower first ring 14 and lower second ring 15 defining a ball bearing race in which are located lower ball bearings 11. Upper second ring 13 and lower first ring 14 lie against opposite sides of a shaft flange **4*a* of shaft 4. Upper first ring 12 lies against the underside of a bushing flange 16*a* of a first bushing 16 which is disposed in a recess 7*a* in a piston rod 7 and which is coaxial with said piston rod. The lower second ring 15 rests against the top side of a holding ring 17 which is rigidly attached to first bushing 16. Upper compression springs 18 are disposed between the top side of bushing flange 16*a* and the radial top wall 7*b* of recess 7*a*. Similarly, lower compression springs 18*a* are disposed between holding ring 17 and a ring-shaped plate 19 which closes off the bottom open end of recess 7*a*. A ball bushing 21 is disposed between first bushing 16 and the face of recess 7*a* which is parallel to it. This ball bushing reduces the friction between first bushing 16 and piston rod 7**.

Referring further to FIG. 2, a support 22 is attached to the bottom end of first bushing 16. This support bears length-measuring device 23. A stop piece 25 acts on moving part 24 of length-measuring device 23. This stop piece is attached to a mounting ring 34 which is mounted on piston rod 7. In FIG. 2, stop piece 25 is in the form of an element which is screwed onto a bolt 26 attached to mounting ring 34, whereby the distance of stop piece 25 from mounting ring 34 can easily be changed. The output of length-measuring device 23 can be used for controlling the pressure force on piston 6.

Length-measuring device 23 may function mechanically, pneumatically, magnetically, or hydraulically.

Piston rod 7 is surrounded between mounting ring 34 attached to its bottom end and the bottom seal 41 of cylinder 8 (see FIG. 1) by a bellows 20 which protects the surface of the piston rod.

In the embodiment of FIG. 2, a continuous signal corresponding to the measured quantity is transmitted from length-measuring device 23 to an electrical comparator (not shown), which compares this quantity with a prescribed value and transmits a change signal to a device (not shown) which determines the advance force acting on piston rod 7; the purpose of the change signal is to change this force in accordance with the current value of the measured quantity.

Figure 3:
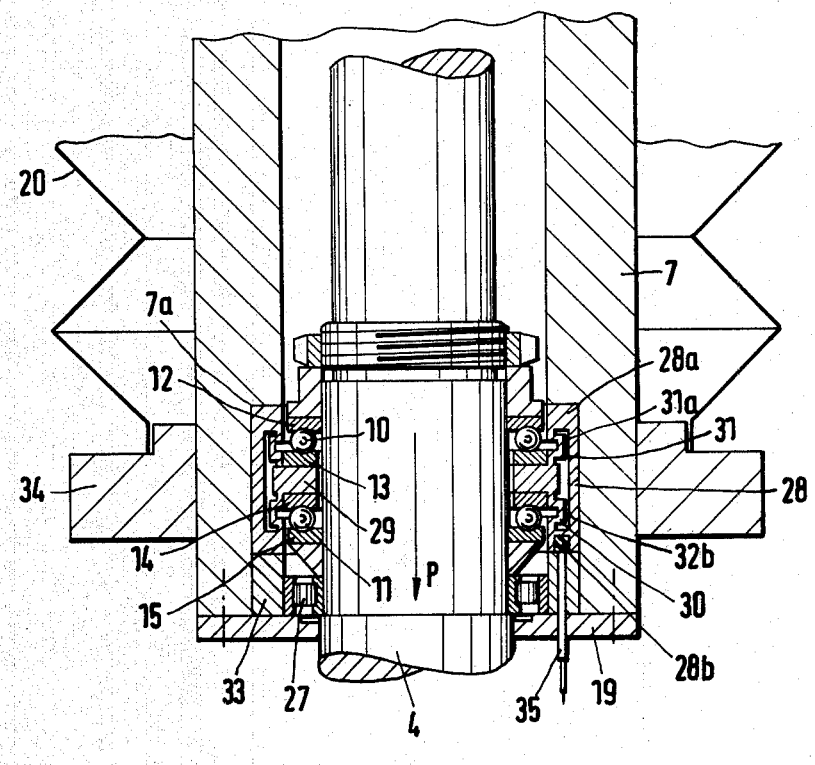
FIG. 3 shows another embodiment of the inventive bearing on the upper lapping disc shaft.

In the embodiment represented in FIG. 3, the lower bearing assemblage 9 comprises two successive ball bearing assemblies similar to the embodiment of FIG. 2, with elements 10, 11, 12, 13, 14 and 15 as defined previously. However, in this embodiment, a roller bearing 27 is provided between lower second ring 15 and a plate 19. Upper first ring 12 and lower second ring 15 are connected directly to shaft 4. Upper second ring 13 and lower first ring 14 are connected to piston rod 7 by a connecting bushing 28 which is set fixedly in a recess 7*a* in rod 7. The inner wall of connecting bushing 28 has a ring-shaped projection 29 disposed between upper second ring 13 and lower first ring 14. Ring-shaped projection 29 is connected to the upper and lower ends 28*a* and 28*b* of connecting bushing 28 via first thin-walled ring 30 and second thin-walled ring 31. Thin-walled ring 30 has a compression strain gauge strip 32*a* and thin-walled ring 31 has a tension strain gauge strip 32*b*. Roller bearing 27 lies between shaft 4 and a second holding ring 33 disposed in the outer opening of recess 7*a* of piston rod 7. Second holding ring 33 and roller bearing 27 are held in place axially by plate 19 which is bolted onto the end of piston rod 7.

Figure 4:
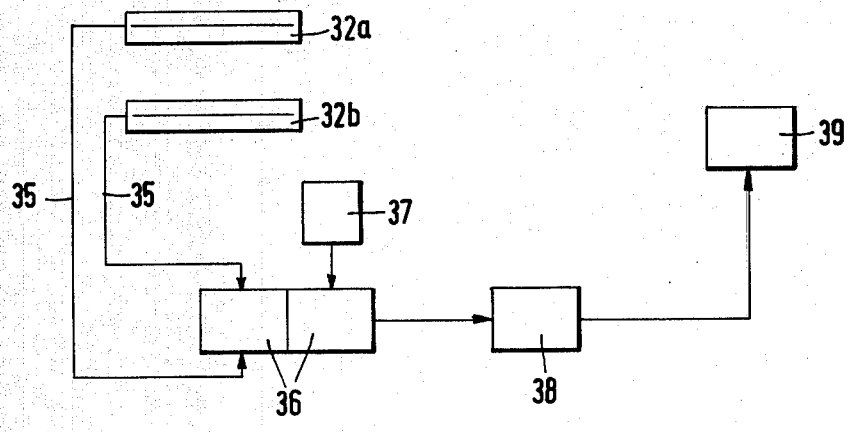
FIG. 4 is a switching diagram for a device according to FIGS. 2 or 3.

Referring to FIG. 3, if the pressure force of the upper lapping disc 3 on the workpiece W is increased, so that shaft 4 via piston rod 7, is moved in the direction of arrow P, strain gauge 32*b* is tensed and strain gauge strip 32*a* is compressed. Strain gauge strips 32*a* and 32*b* are connected, via wires 35 (FIG. 4), to electrical comparator 36, in which the electrical signals produced by said strips are compared with a predetermined signal delivered to the comparator from signal device 37, which latter signal is adjustable depending on conditions. The output signal from comparator 36 is input to a converter device 38 in which it is converted to a control signal for pressure change device 39 (see also FIG. 1) which on one side is connected to a pump 40 for feeding the hydraulic medium which moves piston 6, and on the side is connected, via pipes 39*a* and 39*b*, to upper space 8*a* and lower space 8*b* of cylinder 8 which spaces are separated by piston 6. With this arrangement, the pressure change device 39 causes changes in the pressure in the cylinder spaces 8*a* and 8*b*, in accordance with the signals produced by the strain gauge strips 32*a* and 32*b*, whereby the pressure force in the direction P (FIG. 2) on piston 6, (and thus the pressure force of lapping disc 3 on workpiece W), is changed.

Preferably, the pressure in lower cylinder space 8*b* is maintained constant by pressure change device 39 so that only the pressure in upper cylinder space 8*a* is altered by pressure change device 39, in accordance with the measurement signal produced by the relative movement of shaft 4 and piston rod 7 to each other—the signal, for example, from strain gauges 32*a* and 32*b* or measuring device 23.

The above embodiments are arrangements in which the translation of advance consists of moving upper lapping disc 3 against workpiece W. However, included within the scope of this invention is an arrangement whereby the advance consists of upwardly moving the lower lapping disc 1 which supports the workpiece.

We claim:

1. A working pressure control mechanism for lapping, honing, and grinding machines having a rotatably mounted shaft bearing the tool within an axially translatable housing such that the shaft is carried along by the housing in the direction of the tool advance, comprising a spring means capable of axially translating the housing;

a signal producing means capable of producing a signal corresponding to the magnitude of axial displacement caused by the workpiece and connected to said spring means;

a mechanism advance control means capable of receiving a signal from said signal producing means, and advancing the housing to compensate for the degree of axial displacement; and wherein the shaft is rotatably mounted in a first bushing which is parallel to the axis of the shaft; said first bushing being disposed inside the housing, which housing is a hollow piston rod; said first bushing having at least one region, defined by thin wall rings, along its length which is elastically deformable by the force applied to it due to the advancing motion of the hollow piston rod, and which region contains mounted therein at least one strain gauge strip whose electrical resistance varies with changes in its length; said strip being connected to the input of an electrical comparator which controls the advancing force of the hollow piston rod and by it, through the shaft, the tool.

* * * * *